United States Patent [19]

Mitchell et al.

[11] 3,980,288

[45] Sept. 14, 1976

[54] OPERATING TABLE OR THE LIKE, WITH IMPROVED SLIDABLE TOP ARRANGEMENT

[75] Inventors: Larry D. Mitchell, Ballwin; Murray Q. Tanner, III, Florissant, both of Mo.

[73] Assignee: Affiliated Hospital Products, Inc., St. Louis, Mo.

[22] Filed: Mar. 25, 1975

[21] Appl. No.: 561,886

[52] U.S. Cl. ..... 269/325

[51] Int. Cl.[2] ..... A61G 13/00

[58] Field of Search ..... 269/323, 324, 325; 250/439, 445, 446, 447; 308/72

[56] References Cited

UNITED STATES PATENTS

| | | | |
|---|---|---|---|
| 2,470,161 | 5/1949 | Glasin | 269/324 |
| 3,004,812 | 10/1961 | Miller | 269/323 |
| 3,158,742 | 11/1964 | Morel et al. | 250/439 |
| 3,806,109 | 4/1974 | Weber et al. | 269/323 |
| 3,876,264 | 4/1975 | McCloskey | 308/72 |

FOREIGN PATENTS OR APPLICATIONS

| | | | |
|---|---|---|---|
| 1,485,643 | 4/1966 | France | 269/324 |

*Primary Examiner*—Al Lawrence Smith
*Assistant Examiner*—Robert C. Watson

[57] ABSTRACT

An operating table having a longitudinally adjustably slidable patient supporting table top, the various top sections of which have radio-translucent patient-support panels which, together with the slide arrangement, enable positioning of any top sections for alignment and use with an X-ray photographic or image intensifier apparatus. The table top slide arrangement incorporates four spaced linear ball bushings in which a slide shaft is slidable to enable the desired ease of top positioning to a desired longitudinal position while tilted, flat, and evenly or unevenly loaded or unloaded.

11 Claims, 5 Drawing Figures

76
58
68
126
75
70
121
120
120b
125
123
127
122
125rc
124
111
110
41
70x
41a
41c
170
113
113ss
37
37tp
41b
101
101a
70n
70k
70p
124s
111a
170p
170k
12
123a
123b

OPERATING TABLE OR THE LIKE, WITH IMPROVED SLIDABLE TOP ARRANGEMENT

This invention relates to an improved operating table or the like having a low-friction slidable top arrangement.

It is desirable to provide an operating table which is usable with X-ray photographic or image intensifier equipment, and which is therefore slidable to bring any desired top section and associated supported portion of a patient out of vertical alignment with the table support pedestal, with ease substantially independent of the articulated, unevenly or evenly loaded or unloaded condition of the table top.

It is accordingly a feature of the present invention to provide an operating table which provides ease of sliding movement of the table top, under uneven or even loaded and/or articulated, including lateral tilt, conditions of the top.

It is a further feature to provide such an easily slidable articulatable top, having a radio-translucent patient-supporting surface for enablement of use with X-ray photographic or image intensifier equipment.

Still other objects, features and attendant advantages of the invention will become apparent from a reading of the following detailed description of an illustrative and preferred embodiment constructed in accordance with the invention, taken in conjunction with the accompanying drawings, wherein.

Figure 1:
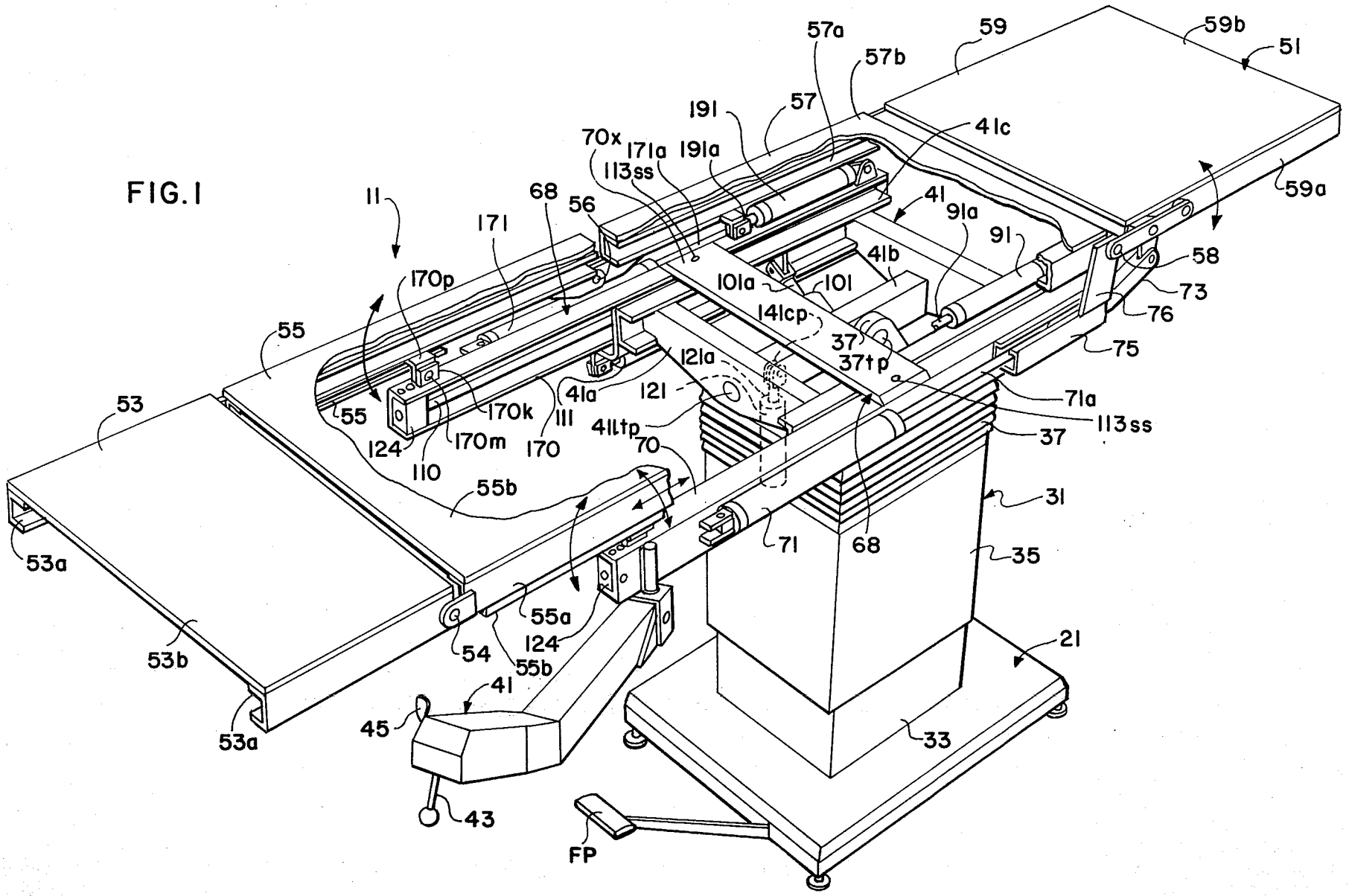
FIG. 1 is a perspective view, in fragmentary cutaway for ease and clarity of illustration, of an operating table according to the invention.

Referring now in detail to the Figures of the drawings, the invention is illustrated as applied to and embodied in an operating table 11 having a top 51 which is longitudinally slidably supported on a vertically adjustable pedestal 31 and base 21. The table top 51 has separate patient support sections 53, 55, 57, 59, which are pivotally secured together as by pivot pins 54, 56, 58, and the top is supported on the pedestal through pivot connections 58 and 170m, connecting between sections 53, 55 and a pair of slide frame U-channel support members 70, 170 which, together with transverse spreader plate 70*x*, form a slide frame 68 for slidably supporting the table top 51.

Table top 51 patient support sections 53, 55, 57, 59 are respectively indicated as head, back, seat and leg sections for ease and conventionality of designation, although it will be appreciated that such sections may support all or a portion of a patient. These pivotally interconnected top sections 53, 55, 57, 59 are selectively articulatable about their respective interconnecting pivots 54, 56, 58, sections 55, 57, 59 being pivotally articulated by actuation of hydraulic cylinders 91, 191, and 71, 171, and head section 53 being manually selectively settably adjustable about pivot 54 relative to back section 55 as by suitable conventional or other desired mechanical means, not shown.

In addition, the entire table top 51 may be laterally tilted by the actuation of hydraulic tilt cylinder 101, which with its rod 101a is suitably connected between the longitudinal pivot beam 41b and a tilt frame 41 which is laterally tiltably mounted through tilt pivot pin or pins 41-1*tp* carried by a longitudinal pivot beam 41*b* which in turn is mounted for forwardly and rearwardly angular movement about a horizontal axis pivot support pin 37 *tp* connecting with and carried by main pivot support block 37. Support block 37 forms the height adjustable effective upper main support end of vertically adjustable pedestal 31.

The tilt frame 41 is formed by longitudinal tilt beam 41*b* which is pivotally connected through pivot pin or pins 41-1*tp* to two lateral beams 41*a*, the ends of which are secured as by welding, to U-channels 41*c*, which connect through slide connections to a slide shaft 110 secured at its opposite ends to slide frame parallel U-channel support members 70, 170 on which the top 51 is articulatably mounted.

Trendelenberg forward and rearward pivotal movement of the table top 51 about the transversely extending horizontal pivot axis formed by pivot pin 37*tp* is effected by a Trendelenberg hydraulic cylinder 121 and 121*a* pivotally interconnecting between longitudinal pivot beam 41*b* and the pedestal upper main support block 37 or a suitable part fixedly secured thereto.

Sliding movement of the top 51 may be suitably effected by actuation of a slide hydraulic cylinder 111 which, with its rod 111*a*, extends and connects between a connection point on the underside of one of the U-channel supports 170 of slide frame 68 and a connection point on the underside of tilt frame U-channel 41*c*.

Leg section 59 may be selectively pivoted about pivot 58 through hydraulic pressure actuation of paired leg cylinders 71, 171, which are connected between the respective slide frame U-channel support members 70, 170 and the leg section 59 through their respective piston rods 71*a*, 171*a* and links 73, 173 the pivot connection of the free ends of rods 71*a*, 171*a* with links 73, 173 being guided by channel guides 75.

Flexing of the seat and back sections 57, 55 may be effected through paired flex hydraulic cylinders 91, 191 which, with their rods 91*a*, 191*a*, connect between seat section 57 and slide frame U-channel supports 70, 170, through suitable opposite end pivot connections. A suitable pivot/slide motion support arrangement for the back section 55 pivot support 170*m* may be provided in order to accommodate the pivotal and sliding movement required by back section 55 during flexing of sections 57 and 55 by cylinders 91, 191. This may suitably take the form of pivot connections on each of U-channels 70, 170, and being indicated for illustration on one side at 170*k*, 170*m*, 170*p*, with pivoted inverted L-shaped slide member 170*p* slidably supportingly engaged in a channel guide 55*b* secured to its respective side frame U-channel 55*a* of back section 55.

Sliding of the table top 51 and the various articulations of the table top sections 53, 55, 57, 59, individually or collectively, are generally referred to herein as table top functions, and may be effected through actuation of the various hydraulic cylinders 71, 171, 91, 191, 101, 111, and 121, as discussed above.

The various table top articulation cylinders 71, 171, 91, 191, 101, 111, 121, may be suitably controlled from a swingably adjustably mounted hydraulic control console generally indicated at 41, having a table top function control handle or lever 43 and an elevate control handle or lever 45, which latter control handle 45 may be employed to control elevate actuation of an elevate hydraulic cylinder in the pedestal 31 to effect height adjustment of the table top 51 through height adjustment of pedestal upper main support block 37.

In order to provide minimum X-ray interference beneath the patient support top sections, the slide frame 68 is formed by two laterally spaced parallel longitudinally extending U-channel members 70, 170, which are connected solely by a transverse spreader plate 70*x* which may be suitably secured thereto as by welding or other suitable securing means. Also, for ease of use in conjunction with X-ray photographic or image intensifier equipment, the various top sections 53, 55, 57, 59 are formed by spaced opposed parallel side U-channels 53*a*, 55*a*, 57*a*, 59*a*, to which are suitably secured top panels 53*b*, 55*b*, 57*b*, 59*b* formed of radio-translucent material such as Benelex composition board. The parallel side U-channels form a channel guide support for slidably inserting X-ray film casettes, which may thereby be slidably removably supported beneath any desired section or sections of the table top radio-translucent panels 53*b*, 55*b*, 57*b*, 59*b*.

The slide frame 68 has slide shafts 110 disposed within each of the channels formed by U-channel members 70 and 170, the slide shafts 110 being secured in place by shaft mounting blocks 124, which in turn are adjustably secured to the opposite ends of the U-channels 70, 170, as through the medium of securing screws of bolts 126, which may be suitably adjusted in position as by slots through which the bolts or screws 126 extend through the U-channels, and by shims 124*s*, as may be required for precise desired parallel positioning of the slide shafts 110 in each of the respective U-channel members 70, 170. A center support guide 133 is also provided for aiding in minimizing undesired deflection of the slide shafts 110 is the course of operation of the table top 51. Center support guides 113 are adjustably secured in place through the medium of set screws 113*ss* extending through spreader plate 70*x* and the respective upper and lower channel walls of the channel members 70, 170.

As previously noted, the tilt frame 41 includes a pair of lateral beams 41*a* for lateral pivoted movement along a longitudinally extending axis formed by lateral tilt pivot pin 41-1*tp* carried by longitudinal pivot beam 41*b*, which in turn is longitudinally tiltable for Trendelenberg and reverse Trendelenberg movement of the table top 51 through the mounting of this longitudinal pivot beam 41*b* on tilt pivot pin 37*tp* extending through and carried by the main pivot support block 37.

The opposite ends of lateral beams 41*a* are secured to spaced apart parallel U-channels 41*c*, as by welding, or by other suitable connection means. Secured to the outwardly facing web portion of the U-channels 41*c* or the tilt frame 41 are four pillow blocks 120, each of which carried a linear ball bushing 122. These pillow blocks 120 may be suitably secured to the respective U-channels 41*c*, as by bolts or screws 120*b*, or other suitable securing means.

Figures 2, 3, 4, 5:
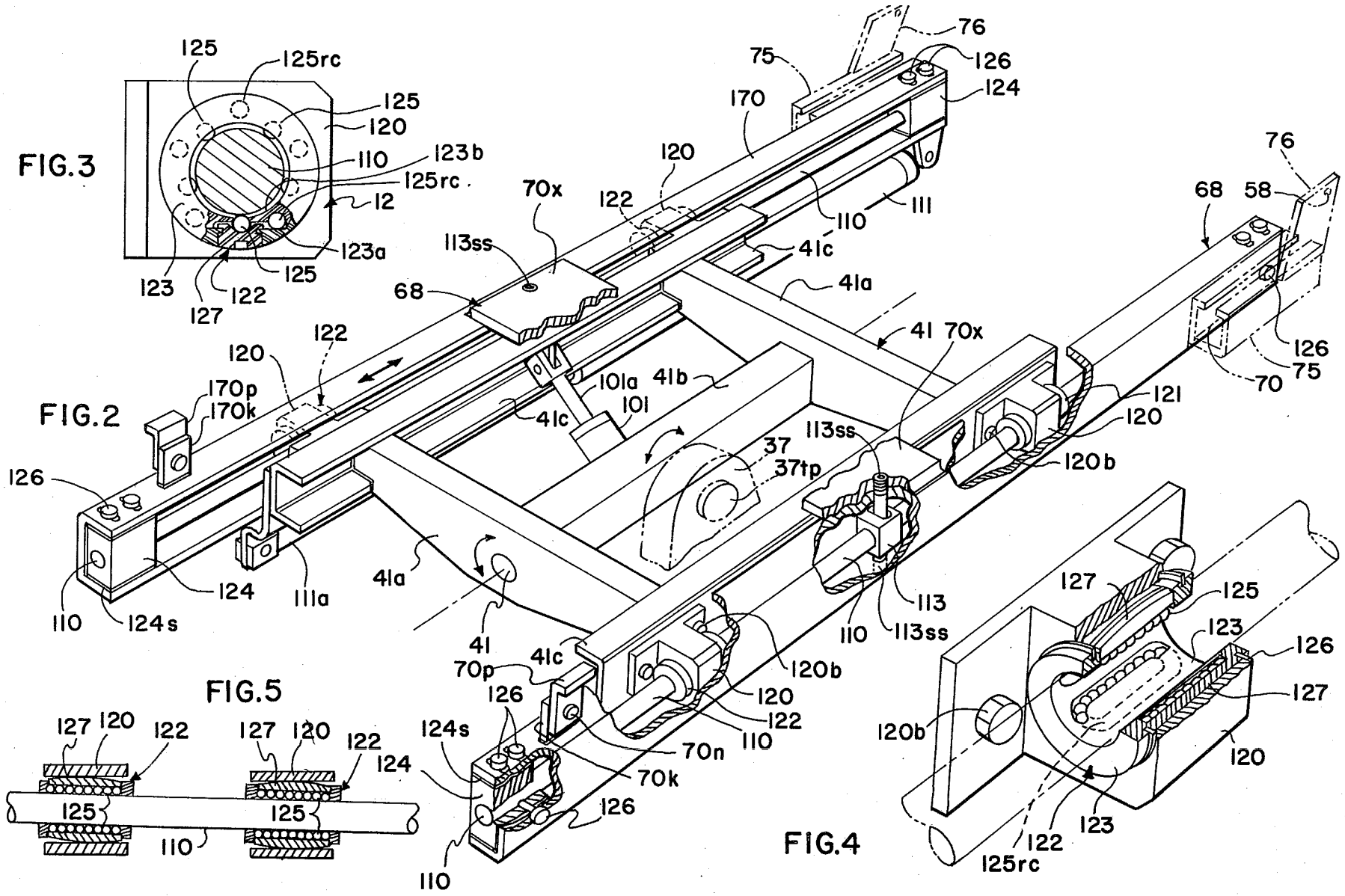
FIG. 2 is a fragmentary illustration in perspective, showing the slide and tilt frame arrangement for the table top of the embodiment of FIG. 1.
FIG. 3 is a cross-sectional view through one of the linear ball bushings of the embodiment of FIGS. 1 and 2.
FIG. 4 is a perspective view, partially cut away of one of the linear ball bushings incorporated in the embodiment of FIGS. 1 and 2.
FIG. 5 is a schematic illustration of the linear ball bushings and slide shaft engagement for a single one of the slide shaft.

The linear ball bushings 122 preferably take the form as illustrated in FIGS. 3 and 4. In this illustrative and preferred embodiment, the linear ball bushing are formed by multiple circumferentially spaced longitudinally extending load-carrying ball bearing runs 125 and interconnecting recirculating ball runs 125*rc*. The load-carrying shaft-engaging balls in the circulating runs 125 directly engage the respective slide shaft 110 along the effective load-engaging length of each run at corresponding circumferentially spaced positions about the circumference of te corresponding slide shaft 110. These circulating ball runs 125, 125*rc* are formed in a ball retention and guiding cage 123 which may suitably be formed of a plastic composition, such as Delrin acetal resin, and which cage 123 is formed as an outer sleeve 123*a* and ball retainer 123*b*, as generally indicated at 123. In order to enable self-alignment of the four ball bushings, to accommodate small deflections or misalignments in the slide shaft 110*s* or deflections of the pillow blocks relative to the slide shafts, the ball bushings desirably include longitudinally tiltable load-carrying bearing plates 127 which engage with the balls forming the shaft-engaging ball run 125. The entire linear ball bushing 122 may be suitably secured in the longitudinal bore of pillow block 120 as by retainer snap rings 127*a*, as generally shown in FIG. 4. The self-alignment capability and linear ball run load-carrying shaft engagement are generally indicated in schematic form in FIG 5. A suitable linear ball bushing for achieving the desired operation is commercially marketed as the Thomson Super Ball Bushing.

In operation, the slide cylinder 111 is selectively actuated through manual control by selective movement of the table top function control handle or lever 43 to effect pressurized liquid movement into one side of the cylinder 111, thereby extending or retracting the piston rod 111*a* and sliding the slide frame 68 toward the head or leg end of the table. This likewise moves the table top 51 in the same direction and to the same extent, thereby moving the table top 51 to the desired longitudinal position relative to the pedestal 31. It will be appreciated that this slide action of the slide frame 68 and table top 51 may be effected independent of the elevation of the table top 51 or the particular tilted or other articulation position of the table top either longitudinally or laterally, as the operation of the slide frame 68 is itself independent of and not restricted by the operating mechanisms for the various other table top and elevate function mechanisms. It will also be appreciated that the four spaced linear ball bushings 122 and sliding shaft 110 support arrangement for sliding movement of the slide frame 68 on the tilt frame 41, enable ease of longitudinal sliding movement of the table top 51 with minimum resistance and required hydraulic actuating pressure to the sliding cylinder 111, in view of the very low friction, and laterally balanced load absorption, provided along the load contact zones of the linear ball bushings 122 with the slide shafts 110. Also, the linear ball bushings may be sized or adjusted to enable direct contact and zero clearance, as desired, along all shaft-engaging runs 125, to thereby enable transfer of vertical and lateral loads between the slide frame 68 and tilt frame 41, at each of the four slide shaft bearing corners of the tilt frame 41, for any table top articulated or tilted position. The circumferential spacing of the multiple (e.g., at least three, and preferably five or more) shaft-engaging ball runs 125 aids in even distribution of the load on the multiple individual bushing balls, as does the longitudinal run extent of the circulating runs 125, as distinguished in the latter case from a ball bearing having only a single annular run of rotatable race-engaging balls as is commonly employed with relatively rotating shaft and associated shaft support elements.

Thus, vertical and lateral loads and moments applied to the top 51 are transmitted to both side channels 70, 170 of the slide frame 68, and since each linear ball bushing 122 can and does transfer radial loads to its respective shaft 110 through a full 360° (in a plane normal to the shaft centerline), the table top loads are carried at both sides and all four bearing support corners of the tilt frame 41. This is particularly advantageous in the present arrangement, in view of the limited structural ties between the slide frame U-channels 70, 170. In this respect, as previously noted, the structural connections between the right and left slide frame channels 70, 170 are desirably minimized to allow access and penetrability for X-ray devices, including conventional X-ray equipment and image intensifiers, and thus the only connection between the two slide frame channels 70, 170 is the spreader plate 70*x*, which as noted previously is welded thereto.

While the invention has been illustrated and described with respect to a particular illustrative embodiment, it will be appreciated that various modifications and improvements may be made without departure from the scope and spirit of the invention. Accordingly, the invention is not to be limited to the particular illustrative embodiment, but only by the scope of the appended claims.

We claim:

1. An operating table comprising:

a longitudinally adjustably slidable patient supporting table top having opposite longitudinal ends, and a support base therefor, a pair of parallel longitudinally extending slide shafts, each of said slide shafts engaging in sliding load transmitting relation within a respective pair of longitudinally spaced apart linear ball bushings, said slide shafts and linear ball bushings connecting respectively in slidable load transmitting and carrying relation between said support base and said slidable table top, a longitudinally extending hydraulic cylinder having a piston rod, said cylinder and rod being in longitudinal forward and rearward movement connection between said support base and said slidable table top, and a transverse tilt frame pivotally connected between said support base and said slide frame through a longitudinally extending pivot member.

2. An operating table according to claim 1, further comprising:

a longitudinally movable slide frame supporting said table top thereon and for longitudinal sliding movement therewith, a support frame connected in load transmitting relation between said slide frame and said support base, said slide shafts being secured in transversely outboard spaced relation on one of said slide frame or support frame, and said linear ball bushings being secured in spaced relation on the other of said slide frame or support frame, said hydraulic cylinder and piston rod connecting between said support frame and said slide frame.

3. An operating table comprising:

a longitudinally adjustably slidable patient supporting table top, and a support base therefor, a pair of parallel longitudinally extending slide shafts, each of said slide shafts engaging in sliding load transmitting relation within a respective pair of longitudinally spaced apart linear ball bushings, said slide shafts and linear ball bushings connecting respectively in slidable load transmitting and carrying relation between said support base and said slidable table top, a longitudinally movable slide frame supporting said table top thereon and for longitudinal sliding movement therewith, a support frame connected in load transmitting relation between said slide frame and said support base, said slide shafts being secured in spaced relation on one of said slide frame or support frame, and said linear ball bushings being secured in spaced relation on the other of said slide frame or support frame, said support frame comprising a transverse tilt frame pivotally secured through a longitudinally extending pivot member to a further vertically movable support frame carried by said support base and being in load-transmitting relation from said table top to said support base.

4. An operating table according to claim 2, said longitudinally extending slide shafts being secured to and forming a part of said slide frame, and said linear ball bushings being secured to and forming a part of said support frame.

5. An operating table according to claim 2, said table top having individually articulatable pivotally interconnected patient support segments, and a further hydraulic cylinder and piston rod connected in pivotal movement-effecting relation between said support frame and one of said individually articulatable pivotally interconnected patient support segments.

6. An operating table according to claim 3, each of said linear ball bushings have at least three annularly spaced longitudinal runs in shaft-engaging load-transmitting and carrying relation in a common bushing housing, and self-aligning load transmitting ball guide members in engagement with each of said shaft engaging ball runs of each of said ball bushings.

7. An operating table according to claim 3, said table top comprising spaced parallel inwardly facing U-channel members, each in superimposed overlying relation above and in transversely closely adjacent relation with the respective said slide shafts and linear ball bushings, onto and between which U-channel members are secured radio-translucent support panels, said U-channel members forming a support channel for removably slidably inserting and supporting X-ray photographic casettes along the length of table top.

8. An operating table according to claim 7, said slide frame comprising spaced parallel longitudinally extending slide-frame-support beams connected by a longitudinally central spreader member and forming an H-frame for providing adequate support strength with minimum X-ray interference, said slide shafts extending along and being carried by said spaced parallel beams.

9. An operating table according to claim 8, said support frame comprising transversely spaced parallel longitudinally extending slide frame support beams connected by two longitudinally spaced apart transversely extending parallel cross beams, said linear ball bushings being mounted on said transversely spaced parallel longitudinally extending slide-frame-support beams, said longitudinally extending slide shafts being secured to and forming a part of said slide frame, and said support base comprising an upstanding single pedestal from which said table top extends in opposite longitudinal directions.

10. An operating table according the claim 9, said longitudinally extending pivot member connecting between said further vertically movable support frame and said two longitudinally spaced apart transversely extending parallel cross beams.

11. An operating table comprising:

a longitudinally adjustably slidable patient supporting table top, and a support base therefor, and a pair of slide shafts, each said slide shafts engaging in sliding load transmitting relation within a respective pair of longitudinally spaced apart linear ball bushings, said slide shafts and linear ball bushings connecting respectively in slidable load transmitting and carrying relation between said support base and said slidable table top, a slide frame supporting said table top thereon and for sliding movement therewith, a support frame connected in load transmitting relation between said slide frame and said support base, said slide shafts being secured in spaced relation on one of said slide frame or support frame, and said linear ball bushings being secured in spaced relation on the other of said slide frame or support frame, said table top comprising spaced parallel inwardly facing U-channel members onto and between which are secured radio-translucent support panels, said U-channel members forming a support channel for removably slidably inserting and supporting X-ray photographic casettes along the length of the table top, said slide frame comprising spaced parallel longitudinally extending slide-frame-support beams connected by a longitudinally central spreader member and forming an H-frame for providing adequate support strength with minimum X-ray interference, said slide shafts extending along and being carried by said spaced parallel beams, said support base comprising an upstanding pedestal from which said table top extends in opposite longitudinal directions.

* * * * *